United States Patent [19]

Yascheritsyn et al.

[11] 3,945,098

[45] Mar. 23, 1976

[54] PULSE IMPACT TOOL FOR FINISHING INTERNAL SURFACES OF REVOLUTION IN BLANKS

[76] Inventors: Petr Ivanovich Yascheritsyn, Leninsky prospekt, 18, kv. 102, Minsk; Jury Khonanovich Golant, Orshanskoe shosse, 118, kv. 40, Mogilev; Vadim Nikolaevich Leushkin, ulitsa Tsiolkovskogo, 8, kv. 30, Mogilev; Gennady Mikhailovich Mironov, Orshanskoe shosse, 120, kv. 52, Mogilev; Anatoly Petrovich Minakov, poselok Kirova, 10, kv. 1, Mogilev; Viktor Vladimirovich Bogachev, poselok Kirova, 8a, kv. 6, Mogilev, all of U.S.S.R.

[22] Filed: Apr. 18, 1975

[21] Appl. No.: 569,378

[52] U.S. Cl. ..... 29/90 R; 72/76

[51] Int. Cl.[2] ..... B24B 39/00

[58] Field of Search ..... 29/90 R; 72/76

[56] References Cited

UNITED STATES PATENTS

| | | | |
|---|---|---|---|
| 1,749,982 | 3/1930 | Nesbitt | 29/90 R |
| 1,917,925 | 7/1933 | Cogsdill | 29/90 R |
| 3,444,714 | 5/1969 | Gustkey | 72/76 |
| 3,517,533 | 6/1970 | Koznar | 72/76 |
| 3,610,008 | 10/1971 | Foedisch | 72/76 |
| 3,696,483 | 10/1972 | Burk | 29/90 R |

*Primary Examiner*—Leonidas Vlachos

*Attorney, Agent, or Firm*—Holman & Stern

[57] ABSTRACT

A tool for finishing the internal surfaces of revolution in blanks including a casing having a groove on its side surface for accommodating bodies of revolution which are moved by a fluid pressure. A fluid is fed in through channels in the tool casing, the channels putting the groove in communication with the source of fluid under pressure. The groove is surrounded by a cage accommodating working elements which are installed with a provision for contacting the bodies of revolution and colliding with them in the operating tool. During this collision the working elements produce plastic deformation of the machined surface with a force which is somewhat smaller than in the known tools used for the same purpose.

4 Claims, 6 Drawing Figures

PULSE IMPACT TOOL FOR FINISHING INTERNAL SURFACES OF REVOLUTION IN BLANKS

BACKGROUND OF THE INVENTION

The present invention relates to tools for mechanical working by the method of plastic deformation and more specifically it relates to tools for finishing internal surfaces of blanks.

The present invention can find a vast field of application in machine building for finishing the internal surfaces of power cylinders, engine liners and precision cylinders in measuring apparatuses.

The invention will prove most effective for machining the internal surfaces of cylindrical or elliptical thin-walled blanks with a comparatively low stiffness.

There is known in the present art a centrifugal-impact tool for machining internal surfaces of revolution in blanks. This tool comprises a solid disc surrounded by a cage which has radial slots arranged uniformly around the circumference and accommodating the working elements in the form of balls. Installed on the bottom of the slots are deflectors which take the forces arising when the balls rebound from the surface being machined after striking the surface under the effect of the centrifugal force.

This known tool is characterized by comparatively large masses of rotating parts which, therefore, have to be accurately balanced. Besides, the points where the balls impinge upon the machined surface and deflectors have to be supplied with a lubricating-and-cooling fluid. The output of the known tool is comparatively low since the contact area of the working elements (balls) with the surface being machined is extremely small.

Another known pulse impact tool for finishing the surfaces of revolution in blanks is installed with a provision for linear motion along the geometrical axis of the surface being machined.

The known tool is designed to machine the external surfaces of revolution by plastic deformation which is accomplished by the impacts of the working elements on the surface being machined. The casing of the tool is a body of revolution provided with a diametrical slot to accommodate the working elements. Also, the casing has a central hole for the passage of the blank. The working elements are constituted by two plates of a high-strength material. On the side facing the blank, the plates have semicylindrical depressions with a radius equal to that of the surface being machined. The surface of these depressions will be referred to hereinafter as "working surface." The working elements are located in the slot of the tool casing with a provision for radial motion to the position where the semicylindrical working surfaces form a cylinder whose axis coincides with the geometrical axis of the hole in the casing. The surface of each plate which is opposite to its working surface is provided with a cylindrical roller soldered along the generatrix of the outer surface of the casing; the diameter of the roller is somewhat smaller than the width of the slot in the casing. Thus, the axis of each roller is parallel to the axis of the working surface of the working element, the distance between these axes being approximately equal to the radius of the external surface of the casing.

The tool casing is surrounded by a cage in the form of a sleeve made integral with an extension which has a hole for the passage of the blank. Pressed into the internal surface of the cage, uniformly around the circumference, are shafts which serve as bodies of revolution. The shaft axes are parallel to the axes of the rollers of the working elements. Part of the shaft surface stands out above the internal surface of the cage to provide contact with the working elements during operation of the tool.

To machine the surface of the blank by the method of plastic deformation tool casing is secured on a hollow spindle of a rotary-swaging machine, coaxially with the spindle. The tool cage is secured immovably. The blank (round bar) is clamped in the collet of the tailstock of the rotary-swaging machine and the end of the blank is inserted into the axial hole of the tool casing.

Then the spindle with the tool casing is set in rotation. The working elements are moved by the centrifugal force from the central axis of the casing until the rollers soldered to them come to the surface of the cage. Moving over the surface of the cage, the rollers impinge periodically on the shafts pressed into the cage. This collision moves the working elements towards the center of the casing and the working elements strike the machined surface of the blank. Inasmuch as the mass and velocity of the working elements are comparatively great but the time of contact with the surface being machined is short, the force of the impact is sufficient to produce plastic deformation of the blank material.

After striking the surface of the blank, the working elements move out again under the effect of the centrifugal force until they collide with the next shaft pressed into the cage. The frequency of impacts depends on the spindle speed and the number of the shafts pressed into the cage. While the tool is in operation, the blank moves linearly and uniformly along the axis of the surface being machined.

In the known tool the zone of collision of the shafts with the working elements and the machining zone of the blank are constantly supplied with a lubricating-and-cooling fluid with the purpose of reducing the temperature which rises due to friction between the surfaces of the above-mentioned elements.

The known tool possesses a number of disadvantages one of which lies in that the working surfaces of the working elements are comparatively large so that plastic deformation of the blank material calls for the application of rather strong forces. As a result, the dimensions of the tool and the mass of its rotating parts are comparatively large and the parts have to be accurately balanced during installation. Also, the shape of the working surface of the working element and the nature of its effect on the surface being machined make it possible to produce only a homogeneous smooth surface whose radius is the same as that of the working surface.

Another disadvantage of the tool lies in the difficulties involved in replacing the worn shafts since they are pressed into the cage.

Still another disadvantage of the tool lies in that it must be constantly supplied with a lubricating-and-cooling fluid because the points of contact between the shafts and the working elements and the machining zone of the blank are considerably heated.

The blanks subjected to machining by the known tool have to be sufficiently stiff.

SUMMARY OF THE INVENTION

It is an object of the present invention to provide a tool for finishing the internal surface of revolution in blanks which produces high-precision parts and allow one and the same tool to be used for machining the internal surfaces of revolution within a certain range of diameters, also to machine blanks with a low stiffness.

Another object of the invention lies in providing a tool which is suitable for making a lubricant-retaining microrelief on the internal surfaces of revolution of blanks when such a design is used in friction pairs.

Still another object of the invention is to provide a tool characterized by a high efficiency and simplicity in operation.

These objects are accomplished by providing a pulse-impact tool for machining the internal surfaces of revolution in blanks, installed with a provision for linear motion along the geometrical axis of the machined surface, comprising a casing in the form of a body of revolution wherein, according to the invention, the external surface of the casing has a circular groove accommodating bodies of revolution which move along the groove and are rotated around their own axis by a fluid under pressure supplied into the casing through a central axial hole provided with at least one outlet channel which is arranged in a plane transverse to the base of the groove and directed practically tangentially to the base of the groove which is concentric with a cage accommodating working elements whose geometrical axes lie in one and the same plane with the geometrical axes of the bodies of revolution located in the cage so that the working elements are capable of contacting the bodies of revolution and colliding with them in the operating tool.

In the tool according to the invention the bodies of revolution are moved by the fluid under pressure. By changing the fluid pressure it becomes possible to achieve stepless control of the speed of the bodies of revolution over the circular groove and, consequently, to control the force applied by the working elements to the machined surface in proportion to the changes in this speed. As a result, the tool according to the invention can be utilized for machining thin-walled blanks with a comparatively low stiffness and for producing different classes of machining within the limits of one and the same blank.

In the course of operation the pressure fluid is supplied into the zone of contact of the bodies of revolution with the working elements after which part of the fluid flows into the machining zone which reduces considerably the effect of temperature during machining and cancels the need for the use of a lubricating-and-cooling fluid.

The tool according to the invention can be realized in a multiple-row form which will step up efficiency of machining by reducing the number of passes of the tool. Several circular rows of such a tool can include different working elements. For example, one row of the working elements can make a special microrelief on the machined surface while another row can machine the surface to the specified surface finish.

In one version of the invention the tool casing is composed of a sleeve mounting two discs whose faces directed towards each other form the side surfaces of the cage groove, at least one disc being installed on the sleeve with a provision for movement along the sleeve axis with a view to adjusting the width of the groove and the cage.

This design allows to have different diameters of the working elements and the bodies of revolution in one and the same tool to suit the particular conditions of machining and the requirements of surface finish after machining. This design also makes it possible to control the radial protrusion of the working elements beyond the outside diameter of the cage which makes the tool adaptable for machining the holes of different diameters at a time.

Also, by changing the width of the circular groove and, consequently, the diameter of the bodies of revolution, it is possible to change the distance between the geometrical centers of the body of revolution and the contacting working element. This changes the angle at which the working element is acted upon by the component of the tangential force arising when the body of revolution moves over the circular groove being subjected to the fluid pressure. This component determines the force of plastic deformation of the blank material.

In another embodiment of the invention the cage has an individual socket for each working element.

Such a design makes it possible to locate a certain number of working elements around the cage circumference. If the number of the working elements is comparatively small and they are equispaced around the circumference, the bodies of revolution moved by the fluid pressure over the circular groove do not encounter such a resistance as that offered to them when they move along a solid row of working elements. Therefore, the bodies of revolution are capable of moving at a higher speed which produces stronger forces of plastic deformation, the fluid pressure being the same.

In the tool of this design it is possible to control the number of depressions made on the machined surface for obtaining the desired microrelief.

It is practicable that each working element be made in the form of a cylinder whose ends are rounded to a sphere with radiuses selected to suit the radius of the body of revolution and the required surface finish of the blank after machining.

By changing the radius of the spheres at the ends of the working element at the side of the bodies of revolution, it is possible to obtain different forces of deformation under the identical working conditions. By changing the radius of the spheres at the side of the machined surface, it is possible to obtain different classes of surface finish under the identical working conditions. For example, comparatively small sphere radiuses are practicable when making the microrelief on the machined surface in the form of a network of depressions while large radiuses of the spheres on the ends of the working elements prove useful in obtaining a high surface finish of the work.

The tool according to the invention is adapted in all cases for machining the surface of the blank during both forward and reverse strokes. This is accomplished because the contact between the working elements and the machined surface is ensured due to interaction of the working elements with the bodies of revolution which are moved by the fluid under pressure.

BRIEF DESCRIPTION OF THE DRAWINGS

Now the invention will be described in detail by way of examples with reference to the accompanying drawings, in which.

DETAILED DESCRIPTION OF THE PREFERRED EMBODIMENT

Figure 1:
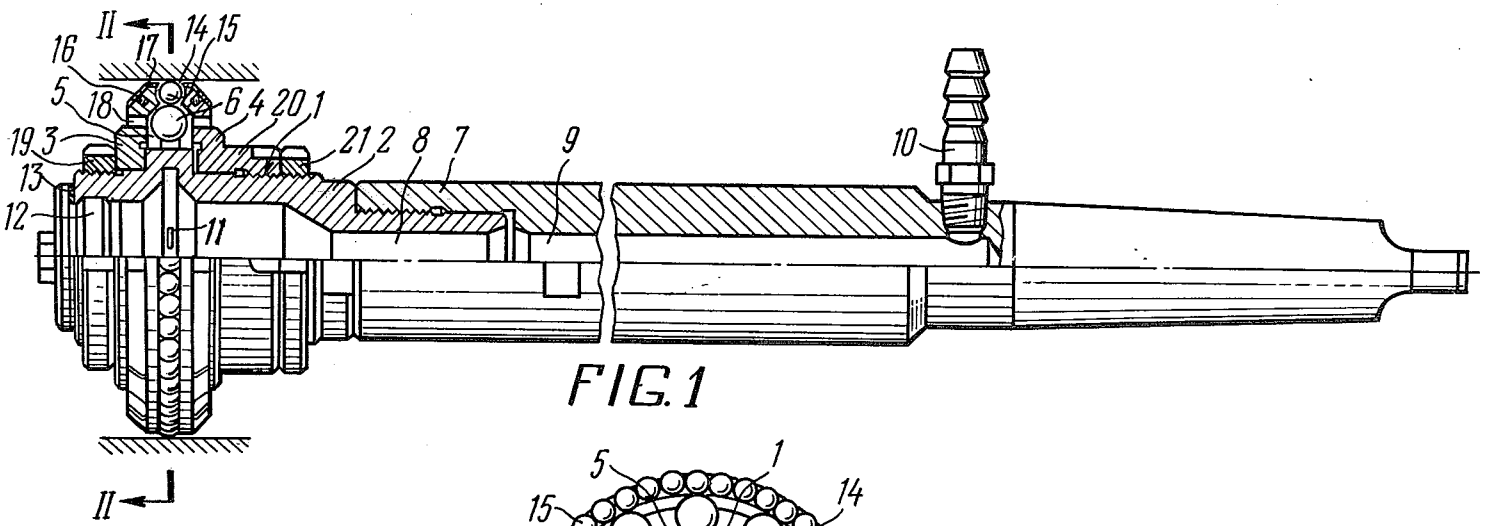
FIG. 1 is a partial longitudinal axial section through the pulse impact tool for finishing the internal surfaces of revolution in blanks according to the invention.

The tool is designed for pulse-impact finishing of the internal surfaces of revolution in blanks. The tool according to the invention comprises a casing 1 (FIG. 1) consisting of a sleeve 2 on which discs 3 and 4 are mounted. The face surfaces of the discs 3 and 4 directed towards each other form a groove 5 to accommodate a number of bodies of revolution 6. A part of the external surface of the casing 1 is threaded for securing the casing 1 in a mandrel 7. The mandrel 7 is intended for clamping the tool in the tailstock of a screw-cutting lathe for which purpose a part of the external surface of the mandrel is tapered. The casing 1 is provided with a through hole 8 merging into a blind hole 9 in the mandrel 7. A hole with a pipe union 10 in the wall of the mandrel 7 serves for the admission of fluid under pressure, in this particular case compressed air, into the casing 1. Channels 11 (FIG. 2) leading from the hole 8 in the casing 1 are arranged in one and the same plane which is transverse to the base of the groove 5 and are directed practically tangentially to the base. The channels 11 serve for the delivery of the compressed air to the bodies of revolution 6 which are thus set in rotary motion and move along the groove 5. To prevent the compressed air from escaping, the hole 8 in the casing 1 is tightly closed by a plug 12 (FIG. 1) with a gasket 13 for which purpose part of the surface of the hole 8 is threaded. The diameter of the bodies of revolution 6 is selected to be sufficient to build up an impact pulse required for machining the surface of a blank under the effect of fluid pressure.

The number of the bodies of revolution 6 in the circular groove 5 is selected so that the total gap between them would be somewhat smaller than the diameter of the body of revolution 6.

A cage 14 made integral with the discs 3 and 4 adjoins the peripheral sections of the latter. The cage 14 accommodates working elements 15 (in this case balls). The working elements 15 and the bodies of revolution 6 are arranged so that their geometrical axes lie practically in one and the same plane. In this example, wherein both the working elements 15 and the bodies of revolution 6 are constituted by balls it is sufficient that their centers lie in one and the same plane. The distance along the radius between the circumferences on which are located the geometrical centers of the bodies of revolution 6 and the working elements 15 during operation of the tool is somewhat smaller than the sum of their radiuses and must be sufficient to produce an impact pulse required for machining the surface of the blank by the method of plastic deformation.

The side surface of the discs 3 and 4 is provided with bevels to which straps 17 are held by screws 16. The edges of the straps 17 facing each other overlap to a certain extent the gap between the surfaces of the cage 14 directed towards each other. These edges are intended to retain the working elements 15 when the tool is being removed from the blank. The width of the groove 5 and the groove in the cage 14 are somewhat larger than the diameters, respectively, of the body of revolution 6 and the working element 15 and for the passage of compressed air through the gaps. The major proportion of the used air escapes from the groove 5 through channels 18 in the discs 3 and 4.

The distance between the base of the groove 5 and the body of revolution 6 in the operating tool should be not less than 2–3 mm.

The external surface of the sleeve 2 is stepped. The maximum-diameter portion of this surface serves as the base of the groove 5. The L.H. section of the sleeve 2 (in the drawing) carries the disc 3 secured by a nut 19. Part of the face surface of the disc 3 bears against the shoulder on the surface of the sleeve 2. The sleeve 2 is threaded for screwing on the nut 19.

The disc 4 is located on the sleeve 2 to the right (in the drawing) from the maximum-diameter section and its L.H. face (in the drawing) bears against a shoulder on the surface of the sleeve 2. The disc 4 is made integral with a bushing 20 whose internal surface fits around the sleeve 2. A portion of its internal surface adjoining its R.H. face (in the drawing) is threaded for screwing it on the sleeve 2.

The length of the plain and threaded portions of the internal surface of the disc 4 and the bushing 20 should be sufficient to allow centering the disc 4 and fastening it securely in any intermediate position with the aid of a lock nut 21. The provision for the movement of the discs 3 and 4 along the axis of the sleeve 2 makes it possible to change the width of the groove 5 and the cage 14.

Figure 3:
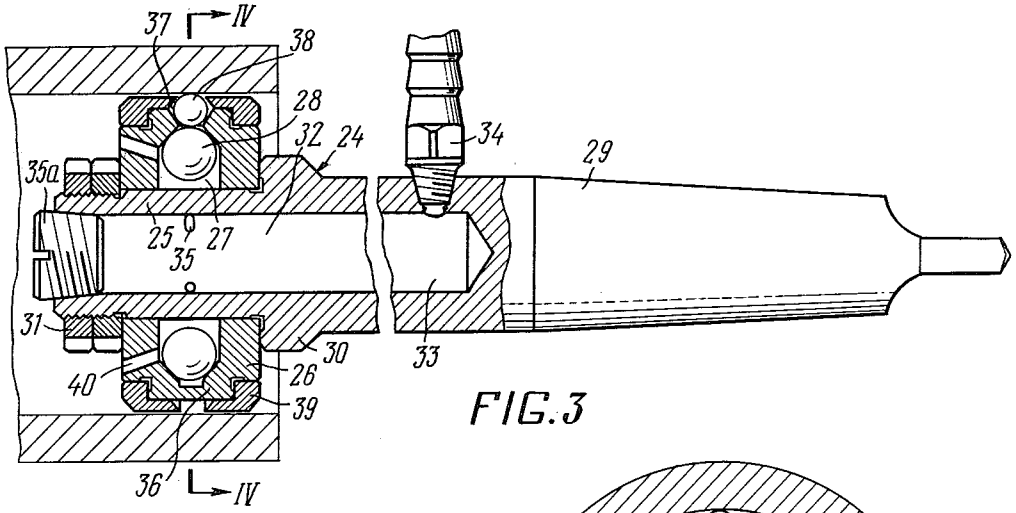
FIG. 3 is a longitudinal axial section through another version of the tool according to the invention.

Shown in FIG. 3 is another form of the tool. This tool comprises a casing 24 which consists of a sleeve 25 and a ring 26 fitting tightly on the sleeve 25. The ring 26 is provided with a circular groove 27 and a portion of the external surface of the sleeve 25 serves as its base. The groove 27 accommodates bodies of revolution 28. Made integral with the sleeve 25 is a mandrel 29 for clamping the tool in the quill of the tailstock of a screw-cutting lathe. The section of the external surface of the mandrel 9 adjoining the sleeve 25 has a circular projection 30 and the R.H. face (in the drawing) of the ring 26 bears against this projection. The ring 26 is fastened on the sleeve 25 by means of nuts 31 for which purpose a portion of the external surface of the sleeve 25 is threaded. The sleeve 25 has a central axial hole 32 which merges into a hole 33 in the mandrel 29. Compressed air is delivered through a pipe union 34 secured in the wall of the mandrel 29. These holes admit the compressed air to the bodies of revolution 28; for this purpose there are channels 35 (FIG. 4) leading from the hole 32. These channels are arranged in one and the same plane which is transverse to the base of the groove 27 and are directed practically tangentially to the base of the groove. To prevent leaks of compressed air, the hole 32 (FIG. 3) is tightly sealed by a tapered threaded plug 35*a*. The diameter of the bodies of revolution 28 is sufficient for producing an impact pulse required for machining the surface of a blank. The number of the bodies of revolution 28 is selected so that the summary clearance between them would be somewhat smaller than the diameter of the body of revolution 28.

The peripheral portions of the ring 26 constitute a cage 36. The cage 36 has sockets 37 to accommodate working elements 38. In the given example the working elements 38 have the form of balls, therefore the sockets 37 are shaped like tapered holes whose apices are directed towards the body of revolution 28. The distance along the radius between the circumferences on which the working elements 38 and the bodies of revolution 28 are located in the operating tool should be somewhat shorter than the sum of their radiuses. In each particular case this distance is selected to suit the material of the blank and to ensure the creation of an impact pulse during collision of the bodies of revolution 28 and the working elements 38. The external side surface of the ring 26 has circular recesses for fastening straps 39. The edges of the straps 39 facing each other cover the sockets 37 so that the clearance between them is somewhat smaller than the diameter of the working element 38.

To ensure delivery of compressed air into the zone of contact between the bodies of revolution 28 and the working elements 38, the width of the groove 27 is made somewhat larger than the diameter of the body of revolution 28 while for the delivery of compressed air to the zone of contact between the working elements 38 and the machined surface the tapered angle of the surface of the socket 37 as well as its larger and smaller diameters are selected to be sufficient to form a gap and allow the passage of air in the process of tool operation. The bulk of the used air is let out from the circular groove 27 through channels 40 in the ring 26.

The number of the sockets 37 and, as a consequence, the number of the working elements 38 is selected to suit the force of the impact pulse required for plastic deformation of the blank material. The smaller the number of the sockets 37, the stronger the impact pulse because the speed of the bodies of revolution 28 moving along the circular groove 27 grows with a reduced resistance of the working elements 38.

The tool of this design can be utilized to make a microrelief on the machined surface.

Figure 5:
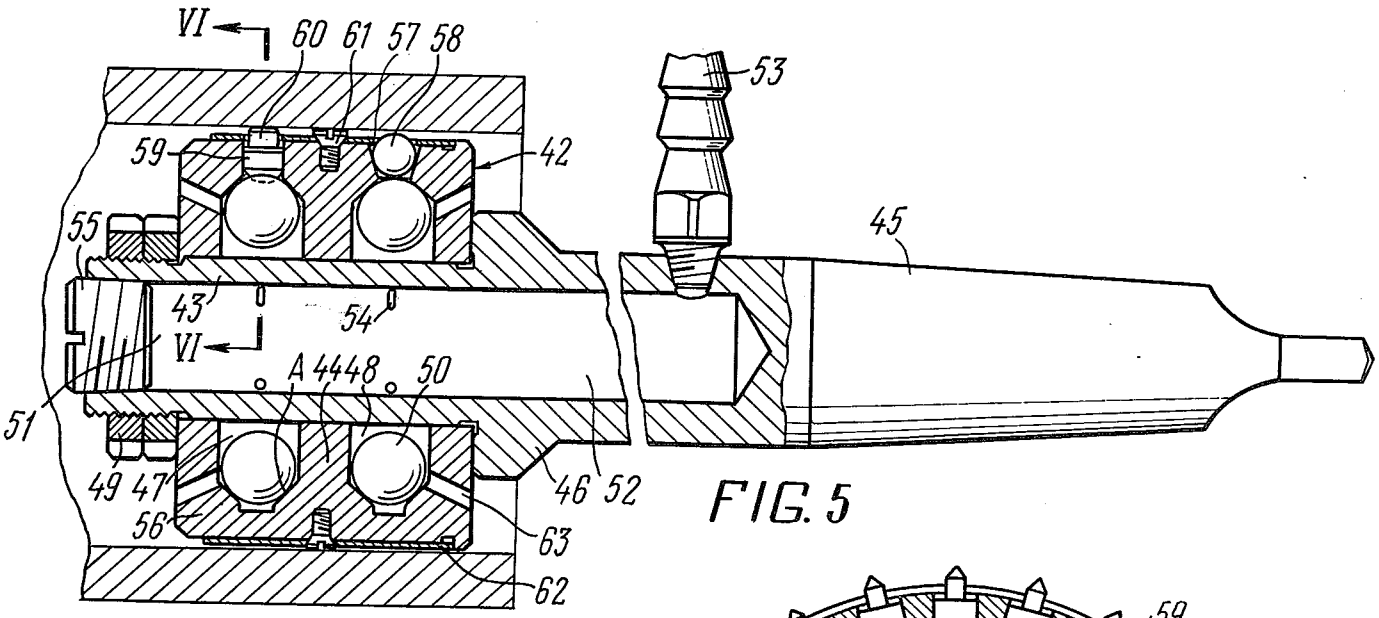
FIG. 5 is a longitudinal axial section of a two-row pulse impact tool.

Shown in FIG. 5 is a two-row impact-pulse tool. It is comprised of a casing 42 which consists of a sleeve 43 and a ring 44 mounted on it. The sleeve 43 is made integral with a mandrel 45. At the point where the sleeve 43 merges into the mandrel 45, the surface of the latter is provided with a circular projection 46 against which bears the R.H. face (in the drawing) of the ring 44. The ring 44 has parallel circular grooves 47 and 48; the bases of these grooves are constituted by portions of the external surface of the sleeve 43. The ring 44 is secured on the sleeve 43 by nuts 49. The grooves 47 and 48 accommodate bodies of revolution 50. The distance between the grooves 47 and 48 is made as short as possible in order to cut down the idle travel of the tool because the thickness of the metal in the ring 44 between the grooves 47 and 48 and the thickness of its side walls should be sufficient if reliability and strength of the tool are to be ensured.

Figure 6:
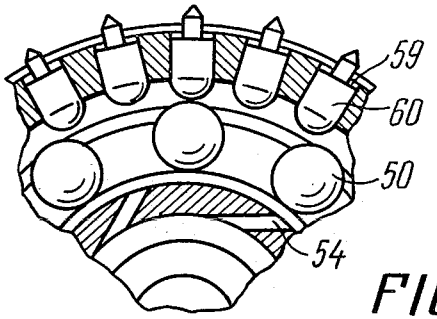
FIG. 6 is a sectional view taken along line VI—VI of FIG. 5.

The sleeve 43 has a central axial hole 51 which merges into a hole 52 in the mandrel 45. These holes admit compressed air which is delivered through a pipe union 53 secured in the wall of the mandrel 45; this air is supplied to the bodies of revolution 50 through channels 54 (FIG. 6) leading from the hole 52. These channels are arranged in two parallel planes, each plane passing through the base of the corresponding groove 47 or 48. The channels 54 are directed practically tangentially to the bases of the grooves 47 and 48.

To prevent leakage of the compressed air, the hole 51 is tightly closed with a tapered threaded plug 55 (FIG. 5).

The peripheral portions of the ring 44 constitute a cage 56. Arranged uniformly around the circumference of the cage 56 are sockets 57 for working elements 58 which are set with a provision for contacting the bodies of revolution 50 located in the groove 48. In the given example the working elements 58 are made in the form of balls and are arranged similarly to the arrangement of the working elements 38 in the cage 36 as illustrated in FIG. 3.

Also, the cage 56 has cylindrical radial sockets 59 for working elements 60 which are set with a provision for contacting the bodies of revolution 50 in the groove 47. Each working element 60 is a cylinder whose ends are rounded to a sphere; the radiuses of these spheres at the corresponding ends of the cylinder are selected in compliance with the radius of the body of revolution 50 and with the radius and the required surface finish of the work. The surface A of the circular groove 47 is designed so that the distance between the circumferences on which are located the centers of the bodies of revolution 50 in the operating tool and the centers of the spheres on the ends of the working element 60 directed towards the ball-shaped bodies of revolution 50 would be somewhat smaller than the sum of radiuses of the spheres. In each particular case this distance is made to suit the material of the blank and the impact pulse required to produce plastic deformation of the material. The higher the required surface finish of the blank after machining, the larger should be the radius of the sphere on the end of the working element 60 facing the blank because this reduces the height of the minute irregularities on the blank surface. However, the smaller the radius of this sphere, the stronger the impact pulse produced by the impingement of the body of revolution 50 upon the working element 60. The height of the cylindrical portion of the working element 60 must be sufficient to preserve its radial movement in the socket 59 in the course of tool operation. The number of the working elements 60 depends on the required surface finish of the blank after machining.

Secured by screws 61 to the external side surface of the cage 56 is a hoop 62 which has the form of a thin-walled ring with two rows of holes whose centers lie on the geometrical axes of the sockets 57 or 59. The radius of the holes in one row is somewhat smaller than the radius of the working element 58 whereas the radius of the holes in the other row is somewhat smaller than the radius of the cylindrical portion of the working element 60. The hoop 62 retains the working elements 58 and 60 in their sockets when the tool is withdrawn from the machined hole and operates outside the blank.

The major proportion of the used air is let out through channels 63 in the side walls of the ring 44.

The tool illustrated in FIG. 1 functions as follows. The tool is secured with the aid of the mandrel 7 in the quill of the tailstock of a screw-cutting lathe coaxially with the machined hole in the blank, the latter being clamped in the lathe chuck. Then the blank is set in rotation and the tool is moved linearly along the axis of the hole being machined. Simultaneoulsy, compressed air is delivered through the pipe union 10 into the holes 8 and 9 and thence, through the channels 11, into the groove 5, rotating the bodies of revolution 6 around their axes and moving them along the groove 5. As the bodies of revolution 6 move along the groove 5 they develop tangential and centrifugal forces whose magnitude depend on the pressure of the compressed air and the mass of the bodies of revolution 6 which come in contact with the working elements 15 and impart an impact pulse to them; as a result, the working elements 15 ensure plastic deformation of the blank material and smooth out the minute irregularities of the surface.

After striking the working element 15 each body of revolution 6 rebounds and is in flight for some time; then, being acted upon by the centrifugal force, each body of revolution comes again into contact with the surfaces of the circular groove 5 serving as a raceway and then moves along the groove 5 until it strikes the next working element 15. The working elements 15 subjected to impacts of the bodies of revolution 6 and contacting the machined surface of the rotating blank also start rotating around their geometrical axes and moving in the cage 14. Rotation of the bodies of revolution 6 and the working elements 15 around their geometrical axes is irregular due to slipping during their contact and during the contact between the working elements 15 and the machined surface; this contributes to their uniform wear. The use of a fluid under pressure, e.g. compressed air, for moving the bodies of revolution 6 and imparting an impact pulse to the working elements 15 through them makes it possible, by changing the fluid pressure, to control the force of the impact pulse to suit the requirements for the surface after its machining. Thus it becomes possible to obtain different categories of surface finish on the portions of one and the same machined surface. After machining the hole in the blank, the tool is withdrawn to the initial position. Should it be necessary to use the back travel of the tool for repeated machining of the surface, the supply of compressed air is cut off after taking the tool completely out of the machined hole.

Figure 2:
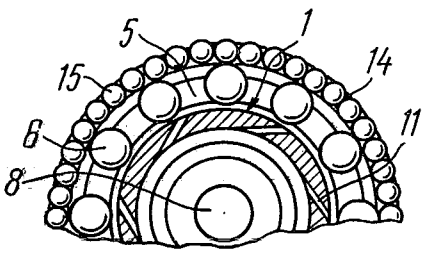
FIG. 2 is a sectional view taken along line II—II of FIG. 1.

The operating principle of the tool illustrated in FIG. 3 differs from that of the tool in FIG. 1 in that the working elements 38 accommodated in the sockets 37 cannot move over the circular trajectory. Inasmuch as the number of the working element 38 in this tool is limited by the number of the sockets 37, the bodies of revolution 28 move most of the time over the surface of the circular groove 27 and produce a smaller number of impacts on the working elements 38. As a result, the machined surface of the blank has a microrelief in the form of a network of depressions.

Figure 4:
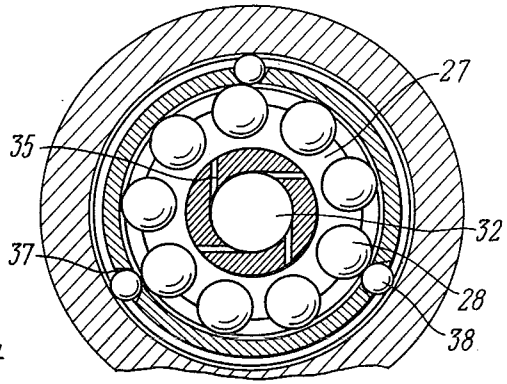
FIG. 4 is a sectional view taken along line IV—IV of FIG. 3.

Operation of the two-row tool illustrated in FIG. 5 is practically identical to that of the tools shown in FIGS. 1 and 3 because the arrangement of the working elements 58 in the cage 56 is similar to the arrangement of the working elements 15 in the cage 14 (FIG. 1) and the arrangement of the working elements 60 in the cage 56 is similar to that of the working elements 38 in the cage 36 (FIGS. 3 and 4).

In this two-row tool the compressed air is delivered through the pipe union 53 and enters both grooves 47 and 48 simultaneously through the holes 51 and 52 and the channels 54. The interaction of the bodies of revolution 50 in both grooves with the working elements 58 and 60, respectively, is similar to that described in the preceding examples. However, in this case the cylindrical working elements 60 machine the hole in the blank to the required surface finish whereas the working elements 58 cut a microrelief on the machined surface.

A multiple-row tool can be used with equal efficiency for machining the surfaces of revolution.

What we claim is:

1. A pulse-impact tool for finishing internal surfaces of revolution in blanks, installed with a provision for linear motion along the geometrical axis of the machined surface comprising: a casing in the form of a body of revolution; at least one circular groove made on the external side surface of the casing; bodies of revolution installed in the groove with a provision for moving along the groove and rotating around their own geometrical axis; the casing provided with a central axial hole; at least one channel leading from the hole in the casing, arranged in a plane transverse to the base of the groove, directed practically tangentially to the base of the groove and used to deliver fluid under pressure to the bodies of revolution which move along the groove and are rotated by the fluid around their own axes; a cage arranged concentrically with and around the groove; working elements accommodated in the cage with a provision for contacting the bodies of revolution and colliding with the bodies of revolution during tool operation; the working elements having geometrical axes which lie in one and the same plane with the geometrical axes of the bodies of revolution.

2. The tool according to claim 1 wherein the casing consists of a sleeve and two discs mounted on the sleeve; the faces of the discs directed towards each other form the side surfaces of the groove and the cage, at least one of the discs being installed on the sleeve with a provision for moving along the axis of the sleeve to allow adjusting the width of the groove and the cage.

3. The tool according to claim 1 wherein the cage has sockets for accommodating each of the working elements.

4. The tool according to claim 3 wherein each of the working elements has the form of a cylinder whose ends are rounded to a sphere, the radiuses of the corresponding ends being selected to suit the radius of the body of revolution and the required surface finish of the blank after machining.

* * * * *